US007709722B2

(12) United States Patent
Shimizu

(10) Patent No.: US 7,709,722 B2
(45) Date of Patent: May 4, 2010

(54) AUDIO SIGNAL PROCESSING APPARATUS

(75) Inventor: Masahiro Shimizu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/055,488

(22) Filed: Mar. 26, 2008

(65) Prior Publication Data

US 2008/0236365 A1 Oct. 2, 2008

(30) Foreign Application Priority Data

Mar. 29, 2007 (JP) ..... 2007-087142

(51) Int. Cl.
*G10H 1/00* (2006.01)

(52) U.S. Cl. ..... 84/600; 700/94

(58) Field of Classification Search ..... 84/600–602; 700/94

See application file for complete search history.

(56) References Cited

U.S. PATENT DOCUMENTS 5,532,862 A * 7/1996 Tada et al. ..... 398/4
5,566,388 A * 10/1996 Brame et al. ..... 370/340
6,088,330 A * 7/2000 Bruck et al. ..... 370/228
6,128,277 A * 10/2000 Bruck et al. ..... 370/221
6,442,758 B1 * 8/2002 Jang et al. ..... 725/119
7,167,442 B2 * 1/2007 Courtney et al. ..... 370/217
7,193,964 B2 * 3/2007 Courtney et al. ..... 370/228
7,301,896 B2 * 11/2007 Tateno et al. ..... 370/227
7,352,780 B1 * 4/2008 Conklin et al. ..... 370/514
2002/0176356 A1 * 11/2002 Courtney et al. ..... 370/216
2002/0176432 A1 * 11/2002 Courtney et al. ..... 370/415
2003/0021241 A1 * 1/2003 Dame et al. ..... 370/321
2003/0185201 A1 * 10/2003 Dorgan ..... 370/352
2004/0050238 A1 3/2004 Okamura
2004/0264364 A1 * 12/2004 Sato ..... 370/217
2006/0219088 A1 10/2006 Okamura
2007/0230494 A1 * 10/2007 Nakayama ..... 370/412
2007/0258359 A1 * 11/2007 Ogasawara et al. ..... 370/218
2008/0008169 A1 * 1/2008 Karino et al. ..... 370/389
2008/0225877 A1 * 9/2008 Yoshida ..... 370/419
2008/0236365 A1 * 10/2008 Shimizu ..... 84/603
2009/0034412 A1 * 2/2009 Sakauchi et al. ..... 370/222

FOREIGN PATENT DOCUMENTS

JP 2004-102131 4/2004

* cited by examiner

*Primary Examiner*—David S. Warren
(74) *Attorney, Agent, or Firm*—Morrison & Foerster LLP

(57) ABSTRACT

An audio signal processing apparatus has a plurality of nodes which include a node in operation and a node on standby for redundancy. Both the node in operation and the node on standby execute the same signal processing on input same audio signals in accordance with supplied same control signals, respectively. Only the node in operation is permitted to output the frame in which the processed audio signals are contained, and the node on standby is prohibited from outputting the frame to the audio bus. In response to a switch instruction, in a sampling cycle, the node in operation turns to be on standby and the node on standby turns to be in operation.

8 Claims, 13 Drawing Sheets current memory provided in RAM (card I/Os)

| |
|---|
| card I/O (0) |
| card I/O (1) |
| card I/O (2) |
| card I/O (3) |
| card I/O (4) |
| card I/O (5) |
| card I/O (6) |
| card I/O (7) |

current memory provided in RAM (cards)

| |
|---|
| analog input/output (0) |
| analog inputs (1, 2) |
| DSP (3,4) |
| DSP (5) |
| digital input/output (7) |

display screen system settings

| A | node | card | group |
|---|---|---|---|
| * | 1 | analog input | 0 |
| | 2 | analog input | 0 |
| * | 3 | DSP | 1 |
| | 4 | DSP | 1 |
| * | 5 | DSP | – |
| | 6 | – | – |
| * | 7 | digital input/output | – |

enter cancel

AUDIO SIGNAL PROCESSING APPARATUS

BACKGROUND OF THE INVENTION

1. Field of the Invention

The present invention relates to an audio signal processing apparatus which enables transmission and reception of audio signals through a bus for transmitting audio signals among a plurality of nodes connected to the bus.

2. Description of the Related Art

An example of a conventional musical tone synthesizer is shown in FIG. 17 as well as shown in Japanese Patent Laid-Open No. 2004-102131, the musical tone synthesizer allowing transmission and reception of audio signals through a bus for transmitting audio signals among a plurality of nodes connected to the bus.

In the musical tone synthesizer shown in FIG. 17, a MIDI I/O (Input/Output) portion 202 inputs and outputs MIDI signals between an external MIDI apparatus. Through the MIDI I/O portion 202, more specifically, MIDI performance information transmitted from a MIDI keyboard or a MIDI performance operator, for example, is input to the musical tone synthesizer. An additional I/O (Input/Output) portion 204 inputs and outputs various kinds of signals other than MIDI signals. A panel switch portion 206 includes various kinds of tone color setting operators manipulated by a user. A tone generator 250, which includes tone generator LSI circuits 252, 254, synthesizes musical tone signals. A display unit 208 displays various kinds of information such as settings of the tone generator 250 for the user. An external storage device 210 is configured by a hard disk and the like. A CPU 212 executes control programs to control various portions of the musical tone synthesizer through a CPU bus 218. A ROM 214 stores the control programs executed by the CPU 212. A RAM 216 is used as a working memory of the CPU 212.

The tone generator LSI circuits 252, 254 which configure the tone generator 250 generate waveform data on the basis of performance information, parameters for emitting tones and the like, the performance information and parameters being supplied through the CPU bus 218. The tone generator LSI circuits 252, 254 also add various kinds of effects to the waveform data on the basis of similarly supplied effect parameters and the like. Add-on boards 256, 258, 260 of the tone generator 250, which carry out various kinds of processing such as synthesizing waveform data, adding effects, and keeping logs according to the type of the add-on boards, help the tone generator 250 achieve certain functions along with the tone generator LSI circuits 252, 254. A bus for transmitting waveform data (hereinafter referred to as "A bus") 262 is a bus which allows transmission of waveform data among the tone generator LSI circuits 252, 254 and the add-on boards 256, 258, 260. The A bus 262 allows transmission of only waveform data having no information on destination address and the like, broadening the transmission band of waveform data.

Because the amount of waveform data transmitted between the tone generator LSI circuits 252, 254 is large, part of the waveform data is transmitted through a line which directly connects the tone generator LSI circuit 252 with the tone generator LSI circuit 254. A DA converter 264 converts waveform data of two channels of output channels of the tone generator LSI circuit 252 into analog signals to emit tones from a sound system 220 on the basis of the converted analog signals for two channels. A word clock generator 251 generates word clock WCK which is pulled up at each sampling cycle. The word clock WCK is supplied to the respective portions of the tone generator 250. A word clock external input terminal 268 is a terminal provided in order to receive externally provided word clock WCK instead of the word clock WCK generated by the word clock generator 251. The word clock external input terminal 268 is used in a case where the tone generator 250 synchronizes the sampling cycle with that of an external apparatus. The add-on boards 256, 258, 260 are detachable from the tone generator 250.

The tone generator LSI circuits 252, 254 and the add-on boards 256, 258, 260 which input/output waveform data via the A bus 262 configure nodes, which are node A, node B and node C. To/from the respective nodes, a data signal ADAT, a direction signals ADIR and a clock signal ACLK are input/output to/from the A bus 262. These nodes are wired-OR connected to the A bus 262 to input/output these signals. While any node outputs a signal to the A bus 262, the input/output terminals of the other nodes are set at high impedance to receive signals transmitted through the A bus 262 as needed. The data signal ADAT is a signal such as waveform data to be transmitted between the nodes, while the clock signal ACLK is a clock signal which synchronizes with the data signal ADAT.

Periods during which the data signal ADAT and the clock signal ACLK are to be output are determined by the CPU 212 so as to avoid overlap among the nodes. The period is referred to as "frame". During the frame period, the direction signal ADIR is set at "L" to prohibit the other nodes from outputting signals. The respective nodes also output a frame signal AFRM pulled up a clock of the clock signal ACLK earlier than pulling up to "H" of the direction signal ADIR. Each frame assigned to each node is defined on the basis of the ordinal position of the frame counted from pulling up of a word clock WCK. Therefore, each of the nodes detects a timing at which a frame of the node starts by counting the number of generated frames since the pulling up of a word clock WCK.

FIG. 18 shows a diagram indicative of timings of a case where node A is assigned frame #2 which is the third frame as a transmission frame, node B is assigned frame #0 which is the first frame, and node C is assigned frame #1 which is the second frame. At time t0 shown in FIG. 18, the word clock WCK is pulled up. The pulling up of the word clock WCK is detected by the respective nodes A, B and C. Node B to which frame #0 is assigned pulls down a direction signal ADIR and a frame signal AFRM to "L" at time t1 when a certain time period has passed since time t0 to output a clock signal ACLK and a data signal ADAT which synchronizes with the clock signal ACLK.

At time t2 when the output of data from node B is completed, the direction signal ADIR of node B is pulled up to "H". Due to pulling up of the frame signal AFRM to "H" a cycle of clock signal ACLK earlier than time t2, node C recognizes that the next frame is frame #1 which is assigned to node C. At time t3 when a certain margin time has elapsed after pulling up of the direction signal ADIR, node C operates similarly to the above description about node B. More specifically, node C pulls down the direction signal ADIR and the frame signal AFRM of node C to "L" to output the clock signal ACLK, and also outputs the data signal ADAT in synchronization with the clock signal ACLK. The margin times between frames are provided in order to prevent collision of data. If the frame signal AFRM of node C is pulled up to "H", node A determines that the next frame is frame #2 which is assigned to node A. After the direction signal ADIR of node C has been pulled up to "H" at time t4, node A executes output processing similar to that described above at time t5 when the certain margin time has elapsed.

SUMMARY OF THE INVENTION

In a case where the conventional audio signal processing apparatus such as a musical tone synthesizer encounters any problem with any of its add-on boards due to deterioration of parts which configure the add-on boards or poor contact, the conventional audio signal processing apparatus is unable to execute signal processing involving the bad add-on board. Although the bad add-on board has to be replaced, the replacement of the add-on board requires temporal shutdown of the system, resulting in interruption of audio signals.

There also has been a well-known redundant system which provides an apparatus which is in operation to actually execute processing and an apparatus which is on standby to take over the apparatus which is in operation in a case where the apparatus in operation encounters any problem. In the case of an audio signal processing apparatus, however, it is desired to avoid interruption of audio signals which are output on the basis of sampling cycles. Therefore, there is a problem that the conventional art applied to other fields cannot be directly applied to the audio signal processing apparatus.

An object of the present invention is to provide an audio signal processing apparatus which is capable of switching nodes between operation and standby without a break in audio signals.

In order to achieve the above-described object, the primary feature of the present invention is an audio signal processing apparatus having a plurality of nodes which include a node in operation and a node on standby for redundancy. The node in operation and the node on standby are controlled to capture the same audio signals in the same frame on the audio bus at each sampling cycle and supplied with the same control signals for controlling the operations of the nodes, such that both the node in operation and the node on standby execute the same signal processing on the input same audio signals in accordance with the supplied same control signals, respectively. Both the node in operation and the node on standby are set to output the same frame to the audio bus, but only the node in operation is permitted to output the frame in which the processed audio signals are contained, and the node on standby is prohibited from outputting the frame to the audio bus. In response to a switch instruction, the node in operation stops outputting the frame to the audio bus and turns to be on standby in a sampling cycle, and the node on standby starts to output the frame to the audio bus and turns to be in operation in the same sampling cycle.

According to the present invention, switching between the nodes which are in operation and on standby is accomplished without a break in audio signals.

DESCRIPTION OF THE PREFERRED EMBODIMENT

Figure 1:
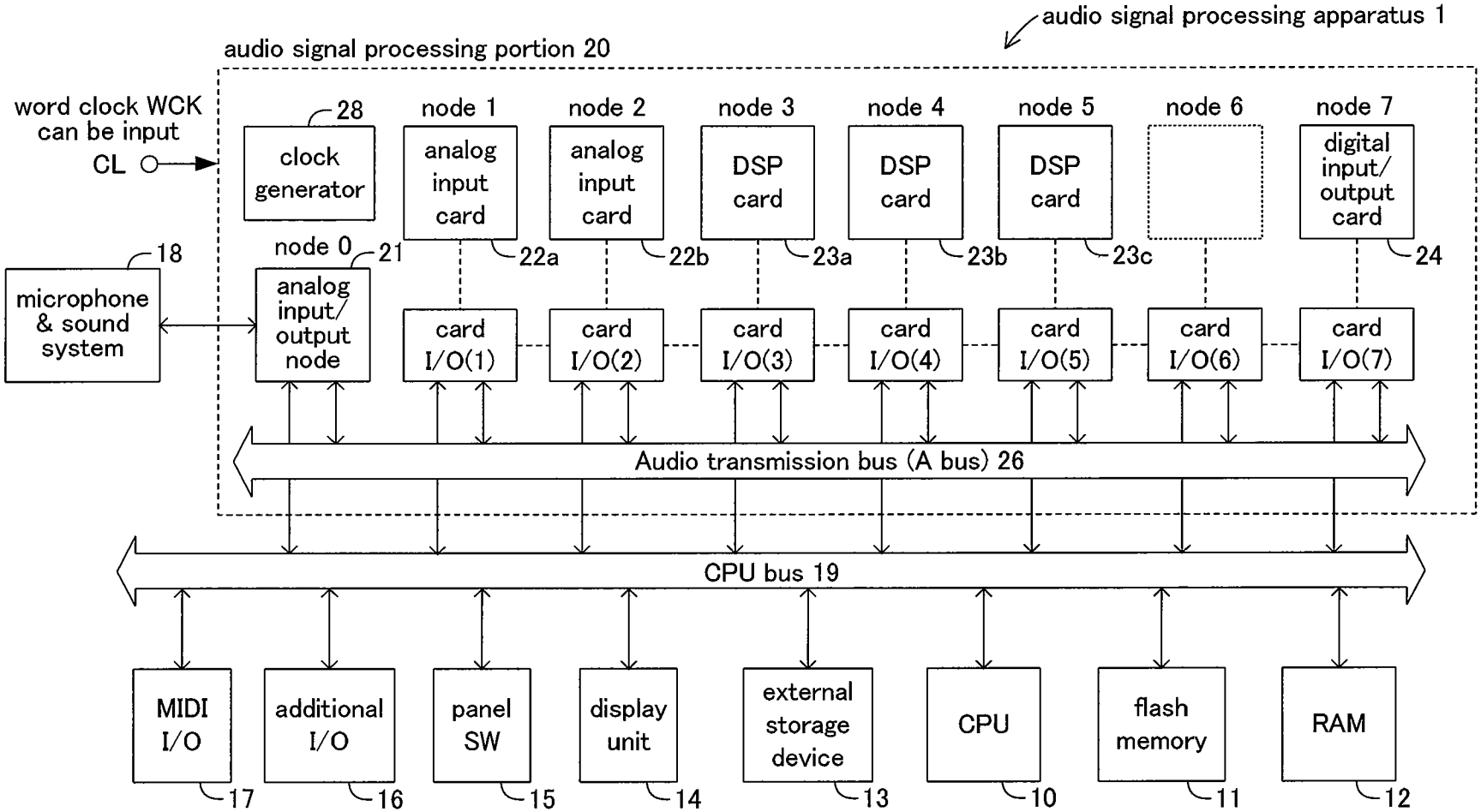
FIG. 1 is a block diagram showing a configuration of an audio signal processing apparatus of an embodiment of the present invention.

FIG. 1 shows a block diagram showing a configuration of an audio signal processing apparatus of an embodiment of the present invention. In an audio signal processing apparatus 1 according to the present invention shown in FIG. 1, a CPU (Central Processing Unit) 10 controls the entire operation of the audio signal processing apparatus 1. The CPU 10 also controls audio signal processing executed by an audio signal processing portion 20. A flash memory 11 stores operational software related to the audio signal processing executed by the audio signal processing portion 20 under the control of the CPU 10. The flash memory 11, which is rewritable, enables rewriting of the operational software, making it easy to update the operational software. A RAM (Random Access Memory) 12 is provided with a working area for the CPU 10 and a storage area for storing various kinds of data. An external storage device 13, which is a large-capacity storage device such as a hard disk storage device, stores operational software, parameters and the like. A display unit 14, which is provided with a display device such as a liquid crystal display, displays on the display device various kinds of setting screens required for the audio signal processing and screens which display programmed settings.

A panel switch portion (panel SW) 15 includes various kinds of operators which are provided on a panel of the audio signal processing apparatus 1, the operators being manipulated by a user. An additional I/O (Input/Output) portion 16 is an input/output portion for inputting/outputting various kinds of signals other than MIDI signals. A MIDI I/O (Input/Output) portion 17 is an input/output portion for inputting/outputting MIDI signals between an external MIDI apparatus and the audio signal processing apparatus 1. Through the MIDI I/O portion 17, MIDI performance information transmitted from a MIDI keyboard or another MIDI performance operator, for instance, is input to the audio signal processing apparatus 1. A microphone & sound system 18 is provided with a microphone which picks up audio signals input to the audio signal processing apparatus 1 and a sound system which emits tones obtained on the basis of the audio signals processed by the audio signal processing apparatus 1. A CPU bus 19 is a bus for transmitting/receiving various kinds of data between the respective portions of the audio signal processing apparatus 1. More specifically, the CPU 10 executes a control program to control the respective portions of the audio signal processing apparatus 1 through the CPU bus 19.

The audio signal processing portion 20, which serves as an audio signal processing portion for acoustically processing audio signals input at each sampling cycle from the microphone & sound system 18 and later-described analog input cards, has an Audio transmission bus (hereinafter referred to as "A bus") 26 for transmitting audio signals. The A bus 26 transmits only audio signals having no information such as destination address. Therefore, the A bus 26 can broaden the transmission band of audio signals. More specifically, the A bus 26 is capable of transmitting audio signals of 512 channels, for example. The audio signal processing portion 20 has eight nodes of "node 0" to "node 7" which serve as nodes for inputting audio signals, nodes for processing audio signals and nodes for outputting processed audio signals. The number of the nodes can be freely determined in the design phase. A word clock generator 28, which is an oscillator such as PLL (Phase Locked Loop), generates word clock WCK which is pulled up at each sampling cycle. The word clock WCK is supplied to the respective portions of the audio signal processing portion 20, so that the eight nodes of "node 0" to "node 7" operate on the basis of the same sampling frequency. In this case, word clock WCK having the sampling cycle may be externally supplied to a clock terminal CL of the audio signal processing portion 20 to synchronize the word clock generator 28 with the externally supplied word clock WCK. In this case, as a result, synchronization of sampling cycle between an external apparatus and the audio signal processing apparatus 1 can be achieved.

"Node 0", which is an analog input/output node 21 provided between the microphone & sound system 18 and the A bus 26, and between microphone & sound system 18 and the CPU bus 19, has an analog input for inputting audio signals of 24 channels, for example, from the microphone & sound system 18 and an analog output of 12 channels for outputting processed audio signals to the microphone & sound system 18. "Node 0", which is not provided with any detachable card, is fixed. "Node 1" is configured by a detachable analog input card 22*a* and a card I/O (Input/Output) (1) for controlling input/output from/to the analog input card 22*a*. The card I/O (1) is provided between the analog input card 22*a* and the A bus 26, and between the analog input card 22*a* and the CPU bus 19. The number of analog input channels of the analog input card 22*a* for inputting audio signals is 32 channels, for example. "Node 2" is configured by a detachable analog input card 22*b* and a card I/O (2) for controlling input/output from/to the analog input card 22*b*. The I/O card (2) is provided between the analog input card 22*b* and the A bus 26, and between the analog input card 22*b* and the CPU bus 19. The number of analog input channels of the analog input card 22*b* for inputting audio signals is 32 channels, for example.

As described above, "node 1" and "node 2" are configured similarly to have the same functions, resulting in dual-redundancy of "node 1" which is in operation and "node 2" which is on standby, for example. To both "node 1" which is in operation and "node 2" which is on standby, the same control signals are supplied from the CPU bus 19. Furthermore, the same audio signals are supplied to the same input channel of the both nodes, so that the same signal processing is carried out in accordance with the same control signals in the both nodes. Outputting of processed audio signals from "node 1" which is in operation to the A bus 26 is permitted, but outputting from "node 2" which is on standby to the A bus 26 is disabled. If a user instructs to switch between operation and standby, the node which is to be in operation is switched to "node 2", while "node 1" is switched to standby. In this case, if the instruction to switch the nodes is made, the nodes are switched between operation and standby in the same sampling cycle. Therefore, the switching of the nodes between operation and standby is accomplished without a break in audio signals. The instruction for switching is made when the user manipulates the panel switch portion 15 to switch the nodes, or when any malfunction is detected in the node which is in operation.

In a case where the nodes are designed to be dual-redundant to have the node which is in operation and the node which is on standby, the cards which configure the dual-redundant nodes can be hot-swapped. The hot swapping allows the node configured by the card which the user desires to replace to switch to standby even while the audio signal processing apparatus 1 is in operation, enabling switching of a node configured by a card which exhibits any sign of abnormal operation to standby to replace the card in advance. In this case as well, the hot-swapping of the nodes and the replacement of the card are accomplished without a break in audio signals.

Next, "node 3" is configured by a DSP card 23*a* equipped with a DSP (Digital Signal Processor) and a card I/O (3) for controlling input/output from/to the DSP card 23*a*. The card I/O (3) is provided between the DSP card 23*a* and the A bus 26, and the DSP card 23*a* and the CPU bus 19. "Node 4" is configured by a DSP card 23*b* equipped with a DSP and a card I/O (4) for controlling input/output from/to the DSP card 23*b*. The card I/O (4) is provided between the DSP card 23*b* and the A bus 26, and the DSP card 23*b* and the CPU bus 19. Into "node 3" and "node 4", the same programs are loaded through the CPU bus 19 with the same control parameters being also supplied to the nodes to make the nodes have the same functions, resulting in dual-redundancy of "node 3" which is in operation and "node 4" which is on standby, for example. To both "node 3" which is in operation and "node 4" which is on standby, the same audio signals are transmitted through the same input channel via the A bus 26. As a result, the same signal processing is carried out for the audio signals in accordance with the same programs and the same control parameters in the both nodes. This signal processing is the processing for mixing, for instance. The number of input channels for inputting audio signals to "node 3" and "node 4" is 48 channels, for example, while the number of output channels for outputting processed audio signals is 24 channels, for example. Outputting of processed audio signals from "node 3" which is in operation to the A bus 26 is permitted, but outputting from "node 4" which is on standby to the A bus 26 is disabled. The switching of the nodes between operation and standby is done similarly to the case of "node 1" and "node 2". As a result, the switching of the nodes between operation and standby is accomplished without a break in audio signals.

"Node 5" is configured by a DSP card 23*c* equipped with a DSP and a card I/O (5) for controlling input/output from/to the DSP card 23*c*. The card I/O (5) is provided between the DSP card 23*c* and the A bus 26, and the DSP card 23*c* and the CPU bus 19. Into "node 5", programs are loaded through the CPU bus 19, while control parameters are supplied to "node 5" through the CPU bus 19. To "node 5", audio signals of 48 channels, for example, are transmitted via the A bus 26. As a result, signal processing is carried out for the audio signals in accordance with the loaded programs and the control parameters. This signal processing is the processing for mixing, for instance. The number of output channels for outputting audio signals processed in "node 5" is 24 channels, for example. "Node 7" is configured by a detachable digital input/output card 24 and a card I/O (7) for controlling input/output from/to the digital input/output card 24. The card I/O (7) is provided between the digital input/output card 24 and the A bus 26, and between the digital input/output card 24 and the CPU bus 19. To "node 7", control signals are supplied from the CPU bus 19, while audio signals of 24 channels, for example, are transmitted to "node 7" via the A bus 26. As a result, signal processing is carried out for the audio signals in accordance with the control signals to output the processed signals to the A bus 26. The number of output channels is 64 channels, for example.

"Node 6" is a vacant node having no card. "Node 6" is provided with only a card I/O (6) for controlling input/output to/from an attachable card. The card I/O (6) is provided between the attachable card and the A bus 26, and the attachable card and the CPU bus 19. By mounting a DSP card as the attachable card to supply the same programs and control parameters loaded into "node 5" to "node 6" through the CPU bus 19, "node 6" is able to have the same functions as "node 5" to have dual-redundancy of one node which is in operation and the other which is on standby. In addition, by mounting a digital input/output card as the attachable card to supply the same control signals as "node 7" to "node 6" through the CPU bus 19 and to transmit audio signals of the same channel to "node 6" through the A bus 26, "node 6" is able to have the same functions as "node 7" to have dual-redundancy of one node which is in operation and the other which is on standby.

Between the respective nodes, node-to-node communication paths indicated by broken lines connecting the respective card I/Os are provided. The node-to-node communication paths enable communications for instructing to switch between the node which is in operation and the node which is on standby and for permitting the switching.

Figure 2:
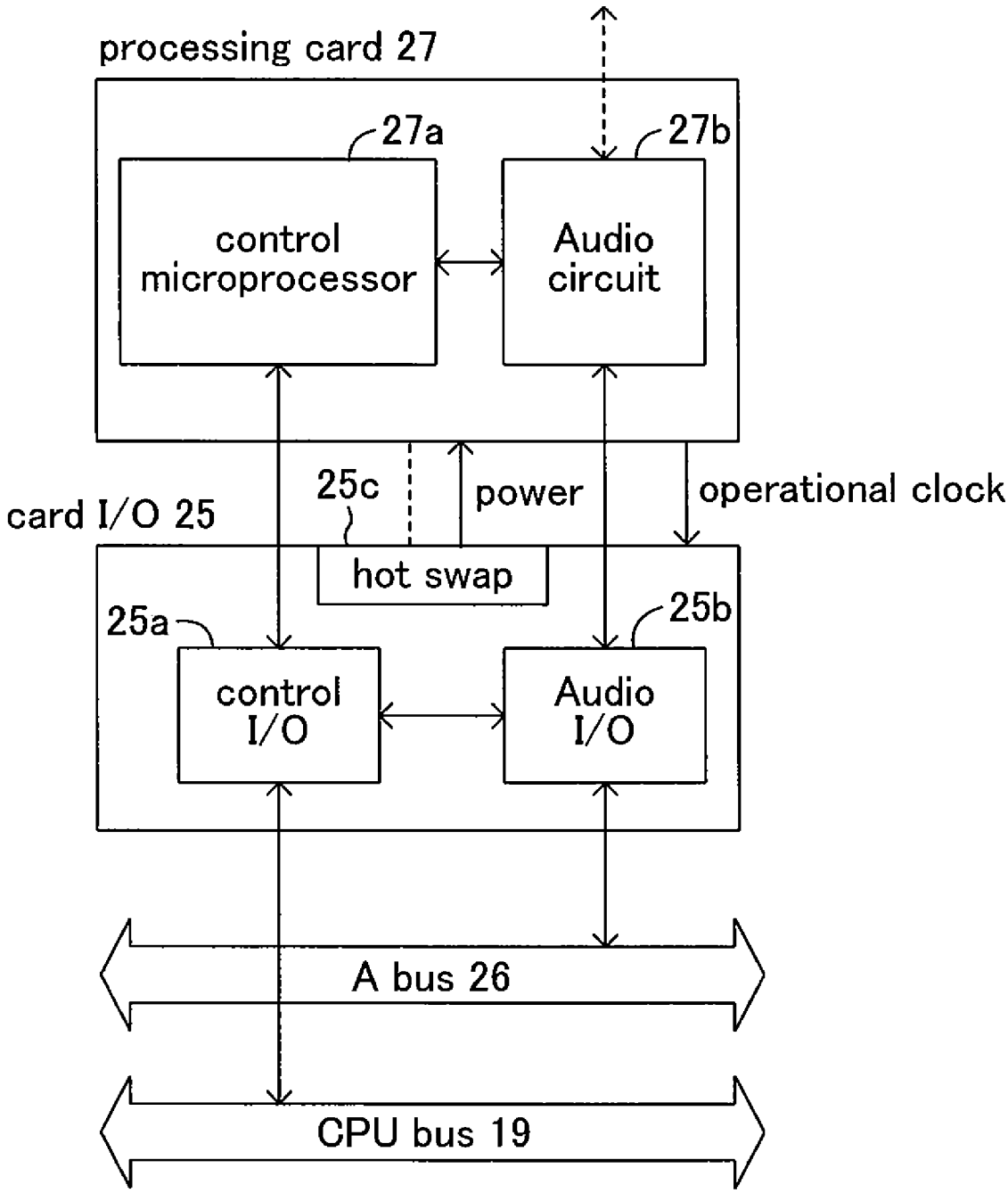
FIG. 2 is a block diagram showing a detailed configuration of a node of the audio signal processing apparatus of the embodiment of the present invention.

Next, a detailed configuration of a node is shown in FIG. 2. FIG. 2 shows a configuration of one node, which is configured by a processing card 27 and a card I/O 25. The processing card 27 is configured by a control microprocessor 27*a* and an Audio circuit 27*b*. The control microprocessor 27*a* executes programs loaded into the processing card 27 or controls the Audio circuit 27*b* in accordance with supplied control signals to acoustically process audio signals supplied to the processing card 27 in the Audio circuit 27*b*. The control microprocessor 27*a* includes a control register which stores control parameters of the Audio circuit 27*b*, while the Audio circuit 27*b* processes audio signals in synchronization with the sampling clock of the audio signal processing portion 20. The card I/O 25, which is provided with a slot to which the processing card 27 is attached, is configured by a control I/O 25*a* provided between the CPU bus 19 and the control microprocessor 27*a*, an Audio I/O 25*b* provided between the A bus 26 and the Audio circuit 27*b*, and a hot swap circuit 25*c* for hot-inserting/removing (hot-attaching/detaching) the processing card 27 into/from (to/from) the slot. The control I/O 25*a*, which is a communications I/O between the CPU 10 and the control microprocessor 27*a*, includes a control register which stores control parameters of the Audio I/O 25*b*. The Audio I/O 25*b* is provided with a buffer for temporarily storing receiving signals transmitted from the A bus 26 to the processing card 27 and sending signals transmitted from the processing card 27 to the A bus 26 to control input/output of audio signals between the A bus 26 and the Audio circuit 27*b*.

From the processing card 27, an operational clock is supplied to the card I/O 25, so that the card I/O 25 controls input and output in synchronization with the supplied operational clock. Because the operational clock of the processing card 27 is used as a clock for transmission to the A bus 26, a circuit for passing audio signals between the processing card 27 and the card I/O 25 can be made by a simple configuration. Since the processing card 27 is not directly connected to the A bus 26, in addition, the properties of the A bus 26 will not vary regardless of whether the processing card 27 is attached to the slot of the card I/O 25 or not. Because the transfer rate between the processing card 27 and the card I/O 25 can be lower than the transfer rate of the A bus 26, furthermore, the hot swap circuit 25*c* can be made by a simple configuration. Because operating power is supplied from the hot swap circuit 25*c* to the processing card 27, when the processing card 27 has been attached to the slot, a power line for supplying power to the processing card 27 is connected before a transmission line for transmission and reception of signals between the card I/O 25 is connected.

Figures 3, 4A, 4B:
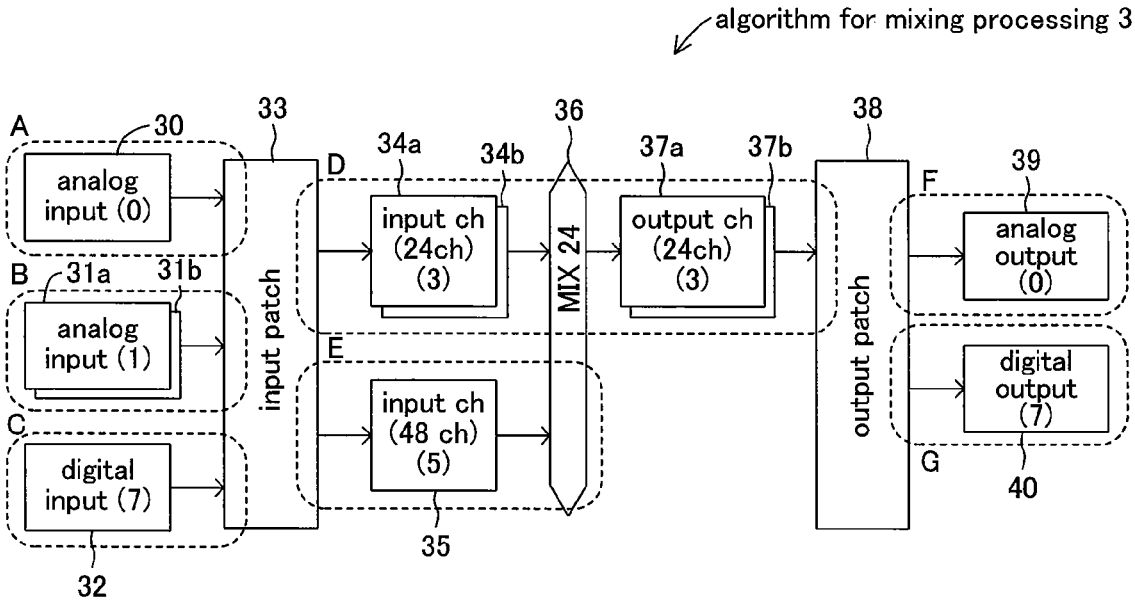
FIG. 3 is a diagram showing an algorithm for mixing processing of a case where the audio signal processing apparatus of the embodiment of the present invention is used as a mixing processor.
FIG. 4A and FIG. 4B show configuration of data stored in current memory provided in the audio signal processing apparatus of the embodiment of the present invention.

FIG. 3 shows an algorithm for mixing processing of a case where the audio signal processing apparatus 1 shown in FIG. 1 is used as a mixing processor. In FIG. 3, a plurality of analog signals input to an analog input portion 30 provided in the analog input/output node 21 of "node 0" are converted to digital signals by an integrated AD converter to be input to an input patch 33. A plurality of analog signals input to the analog input card 22*a* of "node 1" are converted to digital signals by an integrated AD converter to be input to the input patch 33. A plurality of digital signals input to a digital input portion 32 provided in the digital input/output card 24 of "node 7" are directly input to the input patch 33. From the analog input portion 30 to the input patch 33, digital audio signals of 24 channels, for example, are input. From an analog input portion 31*b* to the input patch 33, digital audio signals of 32 channels, for example, are input, while from a digital input portion 32 to the input patch 33, digital audio signals of 64 channels, for example, are input. The analog input portion 31*b*, which is an analog input portion of the analog input card 22*b* of "node 2", receives the same input as an analog input portion 31*a* to similarly convert the supplied signals to digital signals, resulting in dual-redundancy of the analog input portion 31*a* which is in operation and the analog input portion 31*b* which is on standby.

In the input patch 33, a total of 120 channels input from the analog input portion 30, the analog input portion 31*a* (31*b*) and the digital input portion 32 are selectively patched (connected) to the respective input channels of the input channel portion 34*a* having 24 channels, for example, or the respective input channels of the input channel portion 35 having 48 channels, for example, to supply audio signals transmitted from the analog input portion 30, the analog input portion 31*a* (31*b*) and the digital input portion 32 to the input channel portions 34*a* and 35. To the respective input channels of the input channel portions 34*a* and 35, as a result, audio signals transmitted from the input portions and patched in the input patch 33 are supplied. The input channel portion 34*a* is realized by the DSP card 23*a* of "node 3", while the input channel portion 35 is realized by the DSP card 23*c* of "node 5". The input channel portion 34*b* is realized by the DSP card 23*b* of "node 4". More specifically, audio signals which are the same as those patched to the respective input channels of the input channel portion 34*a* are patched and supplied to the input channel portion 34*b* to process the signals similarly to those supplied to the input channel portion 34*a*, resulting in dual-redundancy of the input channel portion 34*a* which is in operation and the input channel portion 34*b* which is on standby.

The respective input channels of the input channel portion 34*a* (34*b*) and the input channel portion 35 are provided with an attenuator, an equalizer, a compressor, a fader and a send adjusting portion for adjusting the level for transmitting to a MIX bus 36 to control frequency balance and the level for transmitting to the MIX bus 36 in the respective input channels. The MIX bus 36 mixes the digital signals of the 48 channels output from the input channel portion 35 to change the digital signals of the 24 channels, and further mixes the changed digital signals of the 24 channels and digital signals of the 24 channels transmitted from the input channel portion 34*a* (34*b*) to the MIX bus 36. The mixed signals are then output from the MIX bus 36. The mixed output of the 24 channels output from the MIX bus 36 is output to an output channel portion 37*a* to obtain 24 different mixed outputs for the 24 channels.

The output channel portion 37*a* is provided with 24 output channels, for example. Each of the output channels has an attenuator, an equalizer, a compressor, and a fader to control frequency balance and the level for transmitting to an output patch 38. The output channel portion 37*a* is realized by the DSP card 23*a* of "node 3". An output channel portion 37*b* is realized by the DSP card 23*b* of "node 4". More specifically, the mixed results of the 24 channels output from the MIX bus 36 to the output channel portion 37*a* are also supplied to the output channel portion 37*b* to process the signals similarly to those supplied to the output channel portion 37*a*, resulting in dual-redundancy of the output channel portion 37*a* which is in operation and the output channel portion 37*b* which is on standby.

In the output patch 38, any one of the 24 channels of the output channel portion 37*a* (37*b*) is selectively patched (connected) to any of output ports of an analog output portion 39 or a digital output portion 40 to supply mixed signals output from the channel patched in the output patch 38 to the selectively patched port (output port). The analog output portion 39 is realized by an analog output portion of the analog input/output node 21 of "node 0", while the digital output portion 40 is realized by a digital output portion of the digital input/output card 24 of "node 7".

A part enclosed with a broken line A shown in FIG. 3 and a part enclosed with a broken line F are realized by the function of "node 0", while a part enclosed with a broken line B is realized by the function of "node 1" or the function of "node 2". A part enclosed with a broken line C and a part enclosed with a broken line G are realized by the function of "node 7", while a part enclosed with a broken line D is realized by the function of "node 3" or the function of "node 4". A part enclosed with a broken line E is realized by the function of "node 5".

In current memory of the RAM 12, areas for storing parameters of a card I/O (0) included in "node 0" and the card I/Os (1) to (7) and areas for storing parameters for signal processing of the cards 22*a* to 24 which configure the respective nodes are created. FIGS. 4A, 4B show the configuration of the areas for the card I/Os and the configuration of the areas for the cards created in the current memory. As shown in FIG. 4A, as the areas for the card I/Os of the current memory, respective areas for the card I/O (0) to the card I/O (7) are provided. The respective areas store parameters of the respective card I/Os. The parameters of the respective card I/Os include a card type, a card ID, dual-redundancy information, transmission control information (frame number, channel), reception control information (frame number, channel), and the like. As for the card I/Os of the nodes of dual-redundancy of operation and standby, output of either of the two is permitted. As shown in FIG. 4B, as the areas for the cards of the current memory, an area for the analog input/output node 21 which configures "node 0", an area shared by the analog input card 22*a* which configures "node 1" and the analog input card 22*b* which configures "node 2", an area shared by the DSP card 23*a* which configures "node 3" and the DSP card 23*b* which configures "node 4", an area for the DSP card 23*c* which configures "node 5", and an area for the digital input/output card 24 which configures "node 7" are provided. Each of the areas stores shared parameters for controlling signal processing. As described above, because the parameters are shared by the cards of dual-redundancy of operation and standby, a shared area of the current memory is provided for the paired cards of dual-redundancy.

The A bus 26 is configured by a data signal line for transmitting audio signals, a clock signal line for transmitting clock signals, a direction signal line and a frame signal line. Periods during which audio signals and clock signals are to be output are determined by the CPU 10 so as to avoid overlap among the nodes. The period is referred to as "frame". During the frame period, a direction signal of "L" level is output from a node to the direction signal line, which prohibits the other nodes from outputting signals. A frame signal pulled up only a clock earlier than pulling up of the direction signal from "L" to "H" is output to the frame signal line. Each frame assigned to each node is defined on the basis of the ordinal position of the frame counted from pulling up of a word clock WCK. Therefore, each of the nodes detects a timing at which a frame of the node starts by making the card I/O count the number of times the frame signal has been pulled up since the pulling up of a word clock WCK. Input/output terminals of "node 0" to "node 7" provided in the A bus 26 to be connected to the respective signal lines are wired-OR connected. As a result, signal lines on which an "L" signal is not output from any node become high impedance ("H"), while the level of a signal line on which an "L" signal is output from any node becomes "L". During a frame period, therefore, the node outputs a frame signal of "L" level to the frame signal line to prohibit other nodes from outputting signals.

Figure 18:
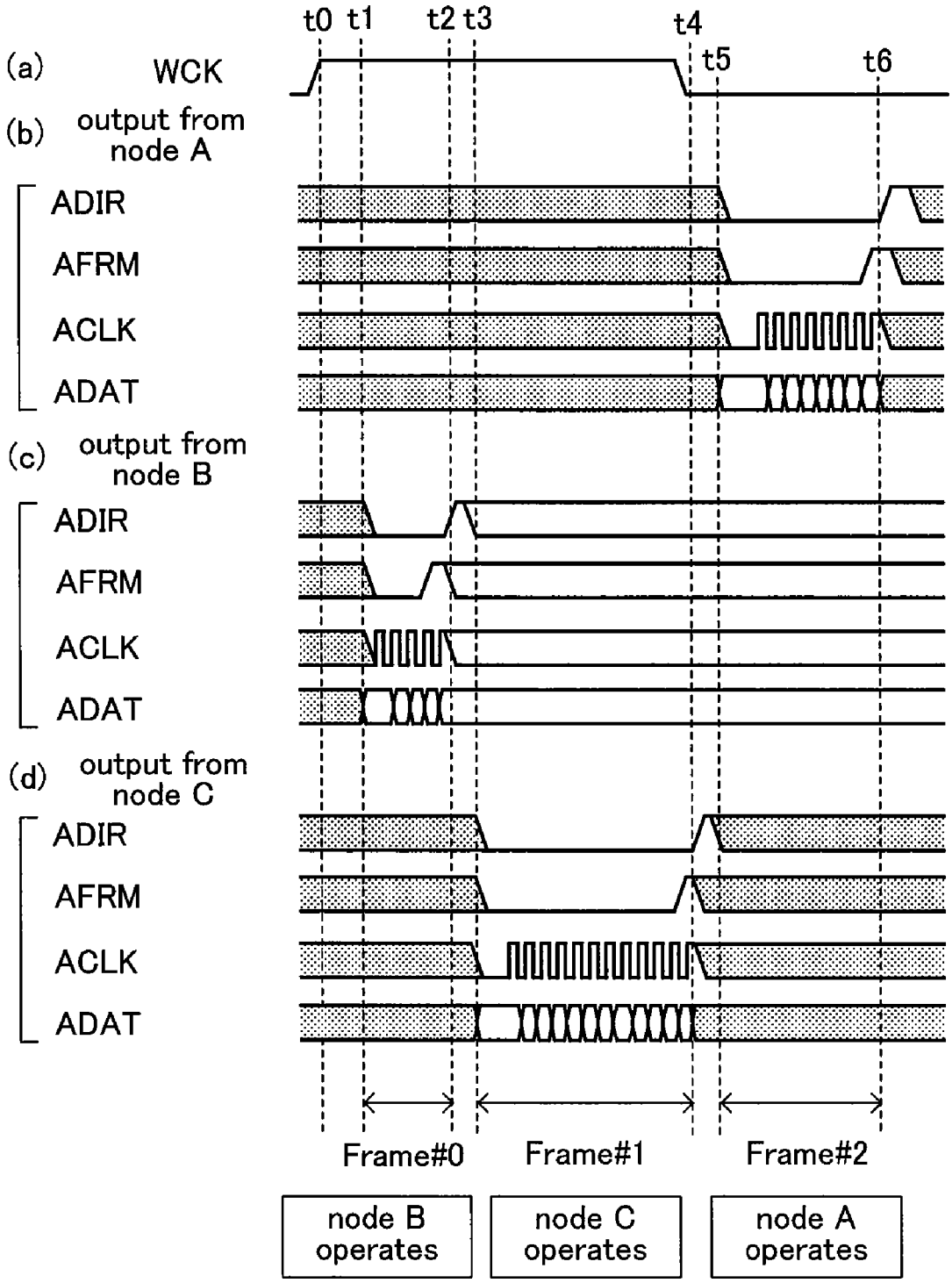
FIG. 18 is a diagram showing timings at which frames are transmitted in the conventional musical tone synthesizer shown in FIG. 17.

By controlling so as to receive audio signals transmitted on the data signal line at the timing of a channel in a frame in which the audio signals to be received are output, the respective nodes can receive audio signals of a desired channel. As described above, data signals output to the data signal line are audio signals such as waveform data to be transferred among the nodes. Clock signals output to the clock signal line are the clock signals which synchronize with data signals. According to the order in which frames appear after the pulling up of the word clock WCK, respective frames are represented as frame #0, frame #1, frame #2 and so on. To the respective nodes, a transmission frame or a plurality of transmission frames can be assigned in one sampling cycle. In this case, a diagram showing timings of transmission from "node 0" to "node 7" in the audio signal processing apparatus 20 is given as an example in FIG. 18.

Figure 5:
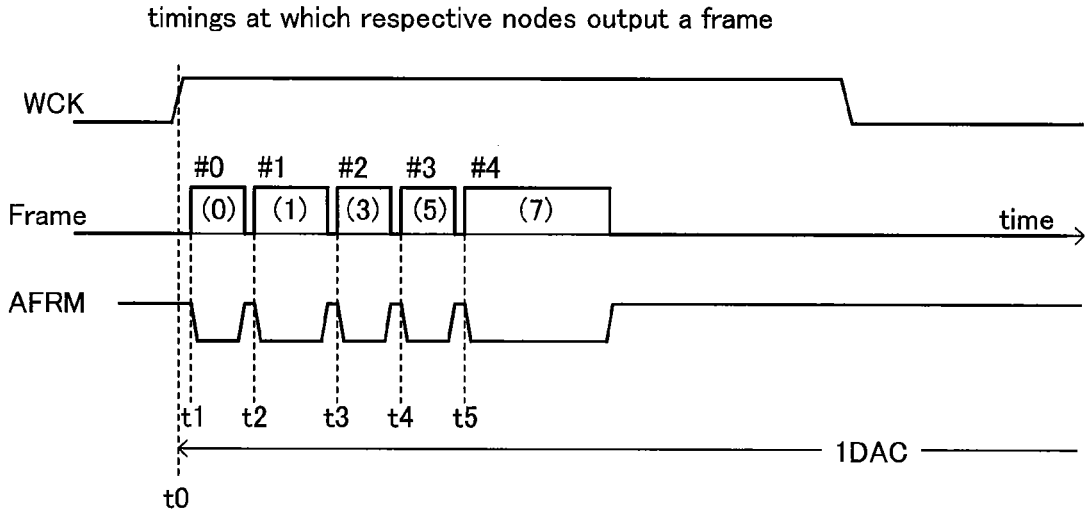
FIG. 5 is a diagram showing timings in which respective nodes output a frame in the audio signal processing apparatus of the embodiment of the present invention.

FIG. 5 shows example timings in which "node 0" to "node 7" output a frame. FIG. 5 shows the timings of a case where "node 0" is assigned frame #0 which is the first frame, "node 1" is assigned frame #1 which is the second frame, "node 3" is assigned frame #2 which is the third frame, "node 5" is assigned frame #3 which is the fourth frame, and "node 7" is assigned frame #4 which is the fifth frame.

In the diagram of the timings shown in FIG. 5, if the word clock WCK is pulled up at time t0, the pulling up of the word clock WCK is detected by "node 0" to "node 7". "Node 0" to which frame #0 is assigned pulls down a direction signal and a frame signal AFRM to "L" at timing t1 when a certain time period has passed since the pulling up of the word clock WCK. Then, "node 0" outputs a clock signal which is not shown to the clock signal line, and also outputs a data signal of frame #0 which synchronizes with the clock signal to the data signal line Frame. Through frame #0, digitized audio signals for 24 channels are output to the A bus 26.

Completion of the output of the data signal from "node 0" causes pulling up of the frame signal AFRM output from "node 0" to "H", also causing pulling up of a direction signal which is not shown to "H" after one clock delay. As a result, "node 1" detects the first pulling up of the frame signal AFRM on the A bus 26 to recognize that the subsequent frame is frame #1 which is assigned to "node 1". Then, "node 1" pulls down the direction signal which is not shown and the frame signal AFRM to "L" at time t2. Then, "node 1" outputs a clock signal which is not shown to the clock signal line, and also outputs a data signal of frame #1 which synchronizes with the clock signal to the data signal line Frame. Through frame #1, digitized audio signals for 32 channels are output to the A bus 26. Margins between the frames are provided in order to prevent collision of data.

Completion of the output of the data signal from "node 1" causes pulling up of the frame signal AFRM output from "node 1" to "H", also causing pulling up of the direction signal which is not shown to "H" after one clock delay. As a result, "node 3" detects the second pulling up of the frame signal AFRM on the A bus 26 to recognize that the subsequent frame is frame #2 which is assigned to "node 3". Then, "node 3" pulls down the direction signal which is not shown and the frame signal AFRM to "L" at time t3. Then, "node 3" outputs a clock signal which is not shown to the clock signal line, and also outputs a data signal of frame #2 which synchronizes with the clock signal to the data signal line Frame. Through frame #2, audio signals for 24 channels transmitted from the output channel portion 37*a* (37*b*) are output to the A bus 26. "Node 5" and "node 7" operate similarly. More specifically, "node 5" outputs frame #3 to the data signal line Frame at time t4, while "node 7" outputs frame #4 to the data signal line Frame at time t5. Through frame #3, audio signals which are the mixed results for 24 channels are output to the A bus 26, while through frame #4, digitally input audio signals for 64 channels are output to the A bus 26. After the completion of output of data signals of all the assigned frames, the respective signal lines of the A bus 26 are kept in a high impedance state until the subsequent pulling up of the word clock WCK. Although the respective nodes are assigned one frame, respectively, in the example shown in FIG. 5, a plurality of transmission frames may be assigned to each node in one sampling (DAC) cycle.

Figure 6:
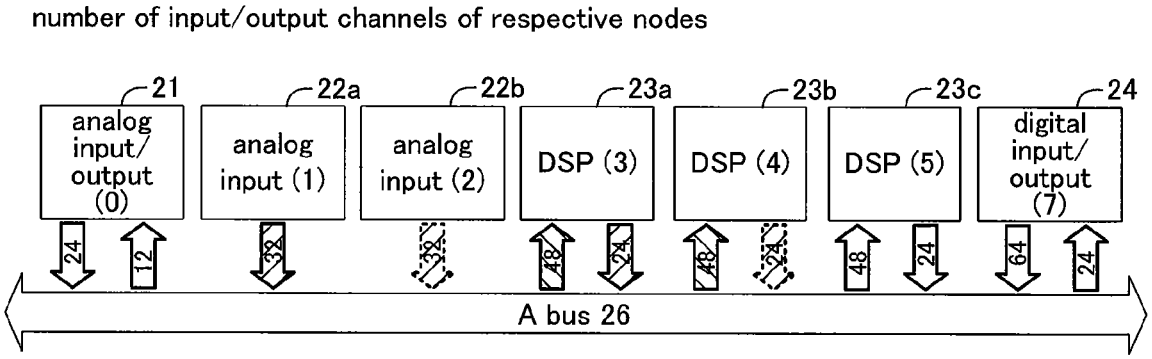
FIG. 6 is a diagram showing an example indicating the number of input/output channels of "node 0" to "node 7" of the audio signal processing apparatus of the embodiment of the present invention.

FIG. 6 shows an example indicating the number of input/output channels of "node 0" to "node 7". In the example shown in FIG. 6, "node 0" has the analog input of 24 channels for inputting analog audio signals from the microphone & sound system 18 to convert the analog signals into digital signals to output the digital signals through frame #0 to the A bus 26 which corresponds to the input patch 33. "Node 0" also has the analog output of 12 channels for converting digital audio signals of patched 12 channels of 24 channels received through frame #2 from the A bus 26 which corresponds to the output patch 38 into analog signals to output the converted signals to the microphone & sound system 18. "Node 1" has the analog input of 32 channels for inputting analog audio signals from the analog input card 22*a* to convert the analog signals into digital signals to output through frame #1 to the A bus 26 which corresponds to the input patch 33. "Node 2" has the analog input of 32 channels for inputting the same audio signals as those input to the analog input card 22*a* from the analog input card 22*b* to convert the analog signals into digital signals to output through frame #1 to the A bus 26 which corresponds to the input patch 33. However, "node 2" is permitted to output to the A bus 26 when "node 2" has been switched to operation.

"Node 3" has the input channels for receiving digital audio signals of patched 24 channels of a total of 120 channels of frame #0, frame #1 and frame #4 from the A bus 26 which corresponds to the input patch 33, the input channels for receiving audio signals of 24 channels which are the mixed results output through frame #3 to the A bus 26 from "node 5" (total of 48 input channels), and the output channels of 24 channels for mixing audio signals input from the input channels of 48 channels to output the mixed results through frame #2 to the A bus 26 which corresponds to the output patch 38. "Node 4" is configured similarly to "node 3". However, "node 4" is permitted to output through frame #2 to the A bus 26 when "node 4" has been switched to operation. "Node 5" receives digital audio signals of patched 48 channels of a total of 120 channels of frame #0, frame #1 and frame #4 from the A bus 26 which corresponds to the input patch 33, and outputs the mixed results of 24 channels mixed by the MIX bus 36 through frame #3 to the A bus 26. "Node 7" has the digital input of 64 channels for inputting digital audio signals from the digital input/output card 24 to output through frame #4 to the A bus 26 which corresponds to the input patch 33, and the digital output for outputting digital audio signals of patched 24 channels received through frame #2 from the A bus 26 which corresponds to the output patch 38 to a digital recorder or the like.

Figures 7, 8:
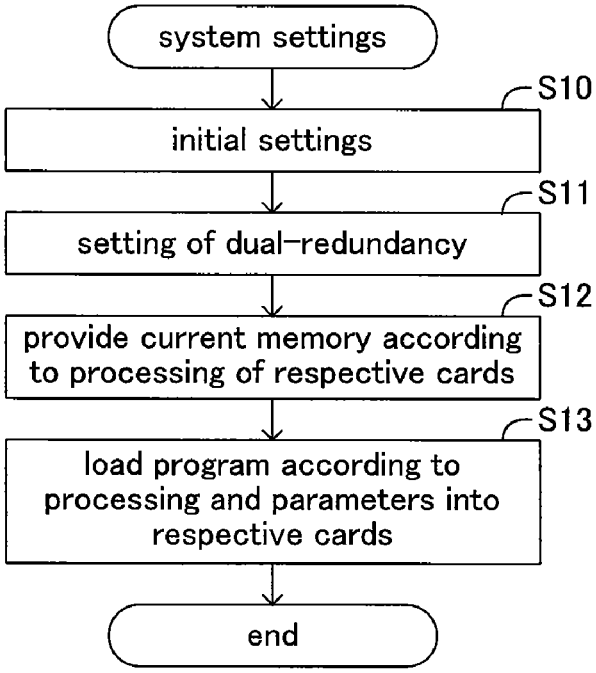
FIG. 7 is a flowchart of a system setting process executed by a CPU on the audio signal processing apparatus of the embodiment of the present invention.
FIG. 8 is a display screen for system settings displayed on the audio signal processing apparatus of the embodiment of the present invention.

FIG. 7 shows a flowchart of a system setting process executed by the CPU 10 of the audio signal processing apparatus 1. FIG. 8 shows a display screen for system settings displayed on the display unit 14 when the system setting process is executed. When the power of the audio signal processing apparatus 1 has been turned on or the system has been reset, the system setting process is started to clear the current settings in step S10 and to display the display screen for system settings shown in FIG. 8 on the display unit 14 to make initial settings. In the initial settings, the respective nodes and the type of the cards mounted to the respective nodes are automatically detected to display node numbers in the node column and the type of the cards such as "analog input", "DSP", "digital input/output" and the like in the card column of the display screen. Because "node 0" is not detachable but fixed, the card type cannot be changed. Therefore, "node 0" is not displayed on the display screen. A group column included in the display screen is provided in order to define dual-redundancy. More specifically, two nodes of dual-redundancy of operation and standby are grouped. The setting of dual-redundancy by use of groups is made by a user. In the shown example, "node 1" and "node 2" are paired to be included in "group 0", while "node 3" and "node 4" are paired to be included in "group 1". In this case, even nodes to which any card is not mounted can be defined as dual-redundancy.

In an "A" column of the display screen, a mark of "*" is provided for the nodes which are considered as active. The nodes which are considered as active are permitted to output processed audio signals to the A bus 26, while the nodes which are considered as non-active process signals but are prohibited from outputting the processed audio signals to the A bus 26. As for the grouped nodes, one node of a group is considered as active. More specifically, "node 1" of "group 0" and "node 3" of "group 1" are considered as active. As for the nodes which are not grouped, "node 5" and "node 7" excluding the node to which any card is not mounted are considered as active. The above-described processing for system settings is carried out in step S11 and later steps of the system setting process.

On completion of the initial setting process of step S10, the setting of dual-redundancy for allowing the user to pair the nodes of operation and standby to include in a group is carried out in step S11. In a case where the dual-redundancy is defined as shown in the display screen of FIG. 8, the number of dual-redundant groups is "2". In step S12, current memory (for cards) for storing parameters for signal processing is provided. The parameters are provided in accordance with processing to be done by the respective cards of the nodes. In a case of the two nodes of dual-redundancy, one memory area is provided for the pair of the nodes. In the case shown in the display screen of FIG. 8, the current memory (for the cards) as shown in FIG. 4B is provided. In step S13, a program corresponding to processing and the parameters for signal processing are read out from the current memory to be load into the analog input card 22*a* to the digital input/output card 24, resulting in the "node 0" to "node 7" becoming operative. As for the setting of dual-redundancy, the nodes of operation and standby may be previously determined by a maker of the audio signal processing apparatus 1. For instance, the (i)th node and the (i+1) node ("i" is an odd number) can be determined as a pair of grouped nodes of dual-redundancy to define the node of an odd number as a node which is in operation and the node of an even number as a node which is on standby.

Figure 9:
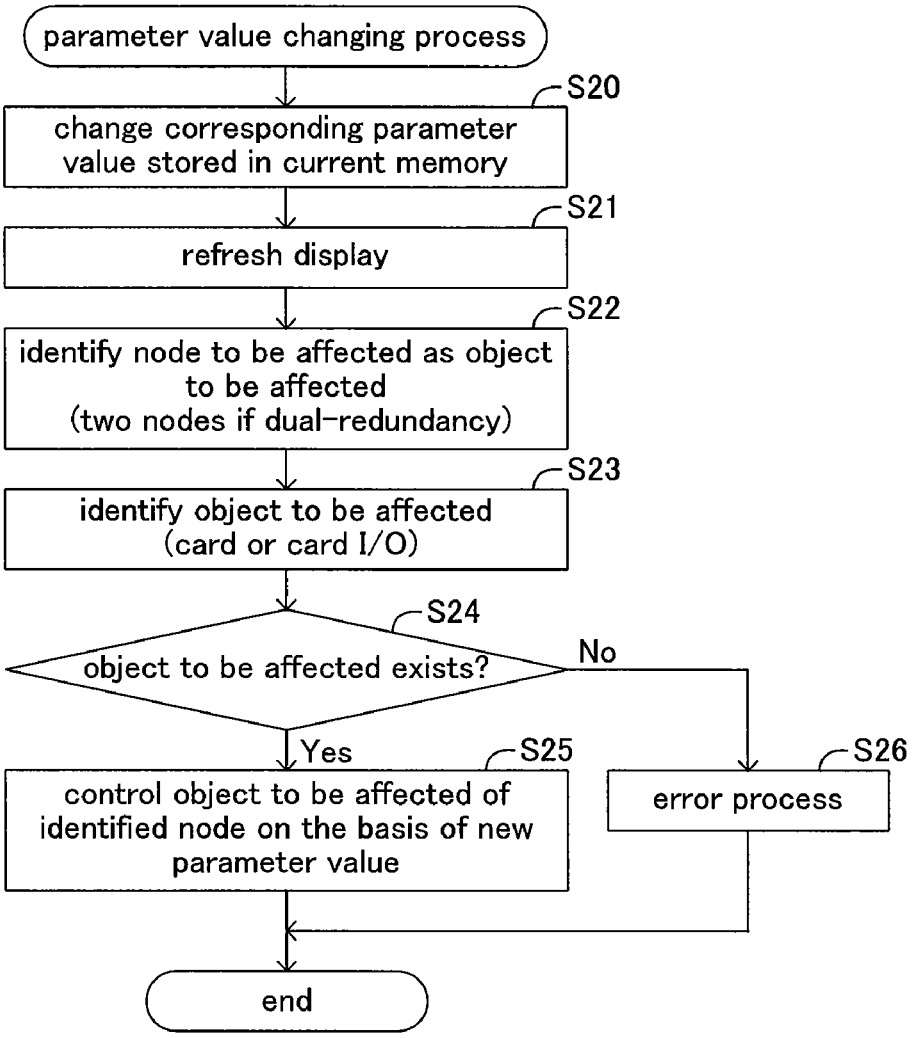
FIG. 9 is a flowchart of a parameter value changing process executed by the CPU on the audio signal processing apparatus of the embodiment of the present invention.

FIG. 9 shows a flowchart of a parameter value changing process executed by the CPU 10 when the user has manipulated the audio signal processing apparatus 1 to change a parameter for signal processing of a node, the parameter being stored in the current memory. When an operator such as a fader or an on/off switch of a channel provided on the panel SW 15 has been manipulated to manipulate a parameter for signal processing, the parameter value changing process is started to change a value of a corresponding parameter stored in the current memory in step S20. In step S21, a displayed parameter is refreshed. In step S22, a node to be affected by the changed parameter is identified as an object to be affected. In a case of dual-redundancy, the two nodes of dual-redundancy are considered as the objects to be affected by the parameter. In step S23, it is determined on the basis of the changed parameter whether the object to be affected is a card or a card I/O. In step S24, it is determined whether the object to be affected by the parameter exists or not. If it is determined that the object to be affected by the parameter exists, the process proceeds to step S25 to load a new parameter value into the object to be affected by the parameter so that the changed new parameter will affect the object of the identified node. The parameter value changing process is then terminated. In a case of dual-redundancy, the new parameter value is loaded into the two nodes of dual-redundancy. If it is determined in step S24 that no object to be affected by the parameter exists, the process proceeds to step S26 to carry out an error process for displaying a screen indicating that there is no object to be affected. The parameter value changing process is then terminated.

Figure 10:
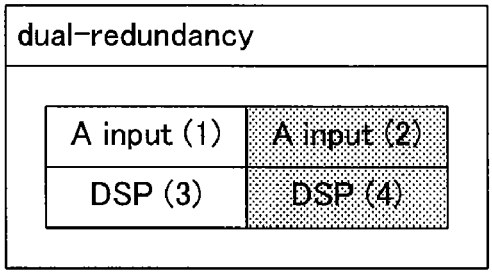
FIG. 10 is a switch screen displayed on the audio signal processing apparatus of the embodiment of the present invention.
Figure 11:
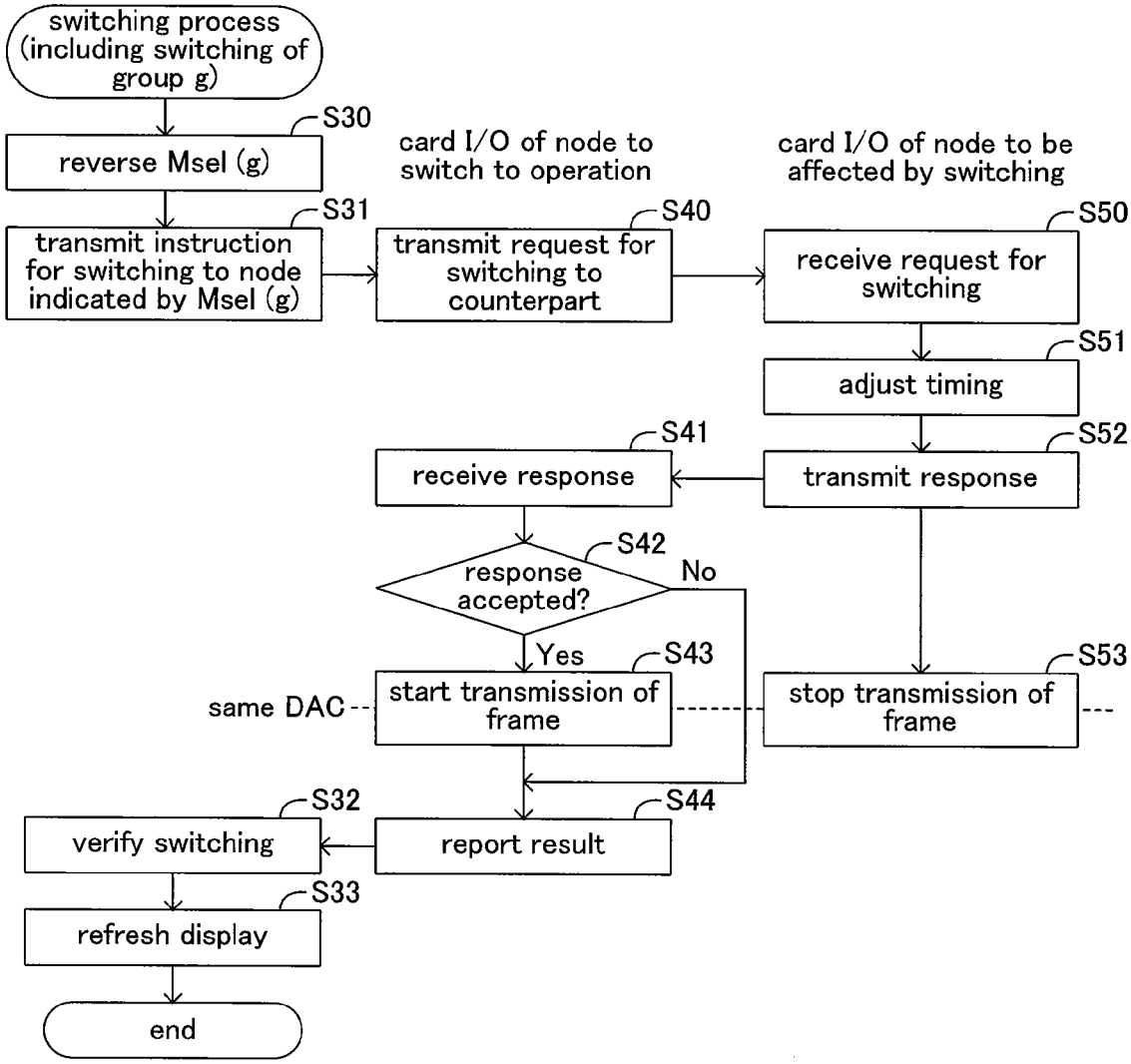
FIG. 11 is a flowchart of a switching process (including switching of group g) executed on the audio signal processing apparatus of the embodiment of the present invention.

In a case where the audio signal processing portion 20 has the nodes of dual-redundancy, a switch screen shown in FIG. 10 for allowing the user to switch only the nodes of dual-redundancy between operation and standby is displayed on the display unit 14. On the switch screen shown in FIG. 10, dual-redundant "node 1" and "node 2" of "group 0" are displayed as "A input (1)" and "A input (2)", while dual-redundant "node 3" and "node 4" of "group 1" are displayed as "DSP (3)" and "DSP (4)". In addition, boxes enclosing "A input (1)" and "DSP (3)" are indicated by heavy lines to indicate that "A input (1)" and "DSP (3)" are in operation. On the switch screen, the user is allowed to switch between the nodes of the respective groups by a manipulation such as placing a cursor at a displayed node to click the node. A flowchart of a switching process (including switching of group g) which is started at the time of the user's manipulation is shown in FIG. 11.

If the user instructs switching of the group g on the switch screen, the switching process is started to reverse, in step S30, a flag Msel (g) of the group g for which the switching process is performed. In step S30, more specifically, the reversed flag Msel (g) indicates a state where the node which is on standby in the group g is turned to the node which is in operation. In step S31, the CPU 10 transmits, to the node which is defined by the flag Msel (g) as the node which is in operation, an instruction to switch to operation. In the node received the instruction to switch (the node which is defined as operation), the card I/O transmits, to the counterpart of the node, a request for switching (step S40). If the node having a lower node number is defined as operation, the flag Msel (g) is turned to "0". If the node having the lower node number is defined as standby, the flag Msel (g) is turned to "1". However, the flag Msel (g) may be designed in a reverse manner.

The card I/O of the counterpart node which is to be affected by the switching (the node which has been in operation) receives the request for switching (step S50) to adjust the time in step S51 until the time when switching is allowed. When the switching is allowed, the card I/O of the counterpart node transmits, in step S52, a response to the node which has transmitted the request for switching. In step S53, transmission of a frame transmitted from the counterpart node to the A bus 26 is stopped.

The transmitted response is received by the card I/O of the node which caused the switching (step S41) to determine in step S42 whether the response regarding the request for switching has been received or not. If it is determined that the response has been received, the process proceeds to step S43 to start transmission of the frame to the A bus 26. In this case, the frame is the one assigned to the node which is to be affected by the switching. The process of step S53 for stopping transmission of the frame and the process of step S43 for starting transmission of the frame are executed in the same DAC cycle. After the completion of the process of step S43 for starting transmission of the frame, the process proceeds to step S44 to report a result indicating that the transmission of the frame is switched from the node which is to be affected by the switching to the node which is defined as operation. The CPU 10, which received the report, verifies, in step S32, that the nodes of the group g have been switched. In step S33, the CPU 10 refreshes the display of the group g on the switch screen shown in FIG. 10 to terminate the switching process.

Figure 12:
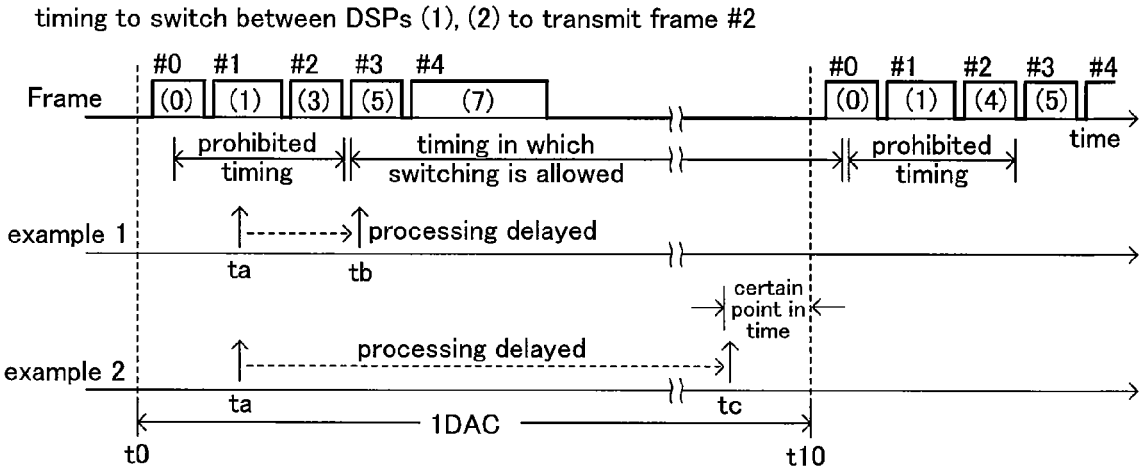
FIG. 12 is a diagram showing timings for switching between a DSP (1), and a DSP (2) (frame #2) on the audio signal processing apparatus of the embodiment of the present invention.

FIG. 12 shows examples of the process for adjusting timing executed in step S51 of the switching process. The examples of FIG. 12 show a case where the node which is in operation in "group 1" is switched from "DSP (3)" which is "node 3" to "DSP (4)" which is "node 4". In FIG. 12, the timings in which the respective nodes output a frame are designed similarly to the timings shown in FIG. 5. Assume that the cursor is placed on "DSP (4)" on the switch screen shown in FIG. 10 to press the enter key to start the switching process shown in FIG. 11, so that "node 3" which is to be affected by the switching receives a request for switching at a timing of ta. As shown in FIG. 12, the time ta falls within a prohibited period during which switching is prohibited. In the first example shown as example 1, therefore, "node 3" adjusts timing until the prohibited period expires, and then "node 3" transmits a response and stops transmission of a frame at time tb. "Node 4" which is received the response and has caused the switching immediately starts transmission of the frame. In the same DAC period starting at time t0, as a result, the process for stopping transmission of the frame by "node 3" and the process for starting transmission of the frame by "node 4" are carried out. In the subsequent DAC cycle starting at t10, resultantly, frame #2 is transmitted from "node 4" to the A bus 26 to transmit audio signals without a break in the audio signals.

In the second example shown as example 2 in FIG. 12, because the time ta when "node 3" which is to be affected by the switching receives a request for switching falls within the prohibited timing during which switching is prohibited as shown in the figure, "node 3" adjusts timing until a certain point in time provided at the end of the DAC cycle to transmit a response and stop transmission of the frame at time tc. Then, "node 4" which has caused the switching and has received the response immediately starts transmission of the frame. In the same DAC cycle starting at time t0, as a result, the process for stopping transmission of the frame by "node 3" and the process for starting transmission of the frame by "node 4" are carried out. In the subsequent DAC cycle starting at time t10, resultantly, frame #2 is transmitted from "node 4" to the A bus 26 to transmit audio signals without a break in the audio signals. The certain point in time provided at the end of the DAC cycle is an allowance provided in order to ensure stable transmission of audio signals for 512 channels on the A bus 26.

Figure 13:
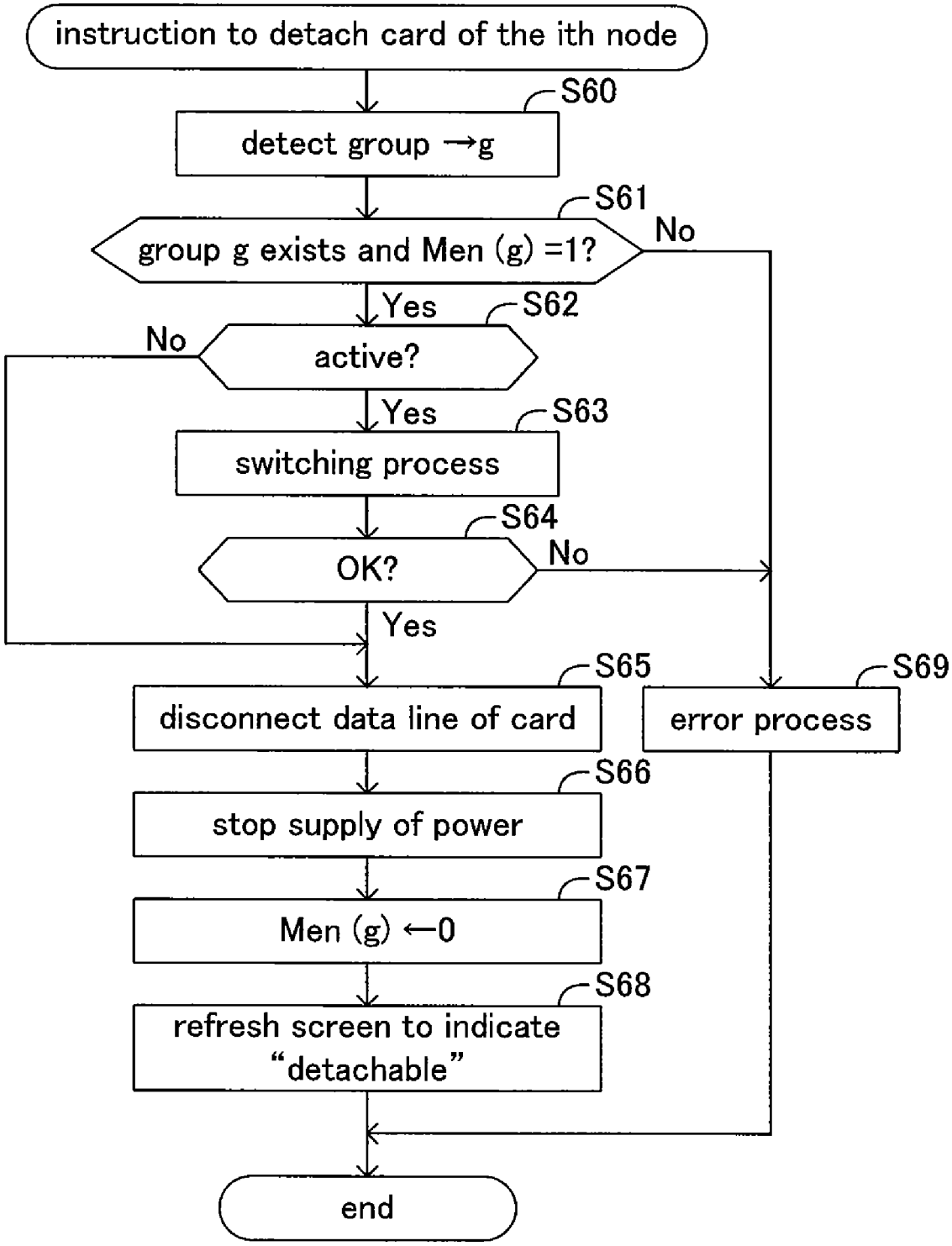
FIG. 13 is a flowchart of a process for instructing to detach a processing card of the (i)th node, the process being executed on the audio signal processing apparatus of the embodiment of the present invention.

FIG. 13 shows a flowchart of a process for instructing to detach the processing card of the (i)th node, the process being executed when the processing card which configures paired nodes is hot-swapped. The process for instructing to detach the processing card of the (i)th node is started when detaching of the processing card is instructed. In step S60, a process for detecting the group g to which the node instructed to detach belongs is carried out. In this detection process, the group g is detected to determine whether the group g is enabled (Men (g)=1) or not (step S61). A state where the group g is enabled is a case where a processing card is attached to the two nodes, respectively, which configure the group g. If it is determined that the group g is enabled and the flag Men (g) is "1", the process proceeds to step S62 to determine whether the (i)th node from which detaching of the processing card has been instructed is active or not. If it is determined that the (i)th node is set active, the process proceeds to step S63 to execute the switching process shown in FIG. 11 for the node which is in operation.

By the switching process, the node from which the processing card is to be detached is switched to standby. In step S64, it is determined whether the node from which the processing card is to be detached has been switched to standby. If it is determined in step S64 that the switching of the node to standby has been completed, the process proceeds to step S65 to disconnect the data signal line of the processing card of the node detaching of the processing card from which has been instructed. In step S66, supply of power to the processing card whose data signal line has been disconnected is stopped. In step S67, the flag Men (g) is reversed to "0" in order to cancel the enabled state. The process then proceeds to step S68 to refresh a screen to indicate that the processing card whose power supply has been stopped is "detachable". The process for instructing to detach the processing card of the (i)th node is then terminated. If it is determined in step S61 that there is no group g or that the group g is not enabled, the process proceeds to step S69 to perform an error process for instructing to turn off the power of the audio signal processing apparatus 1 and to detach the processing card. The process for instructing to detach the processing card of the (i)th node is then terminated. If it is determined in step S62 that the (i)th node is not active, step S63 and step S64 will be skipped, for there is no need to perform the switching process. If it is determined in step S64 that the switching process has not been completed, the process proceeds to step S69 to perform the above-described error process to terminate the process for instructing to detach the processing card of the (i)th node. In the above-described process, the disconnection of the data signal line of the processing card and the stop of power supply are done by the hot swap circuit 25*c* of the card I/O (i).

Figure 14:
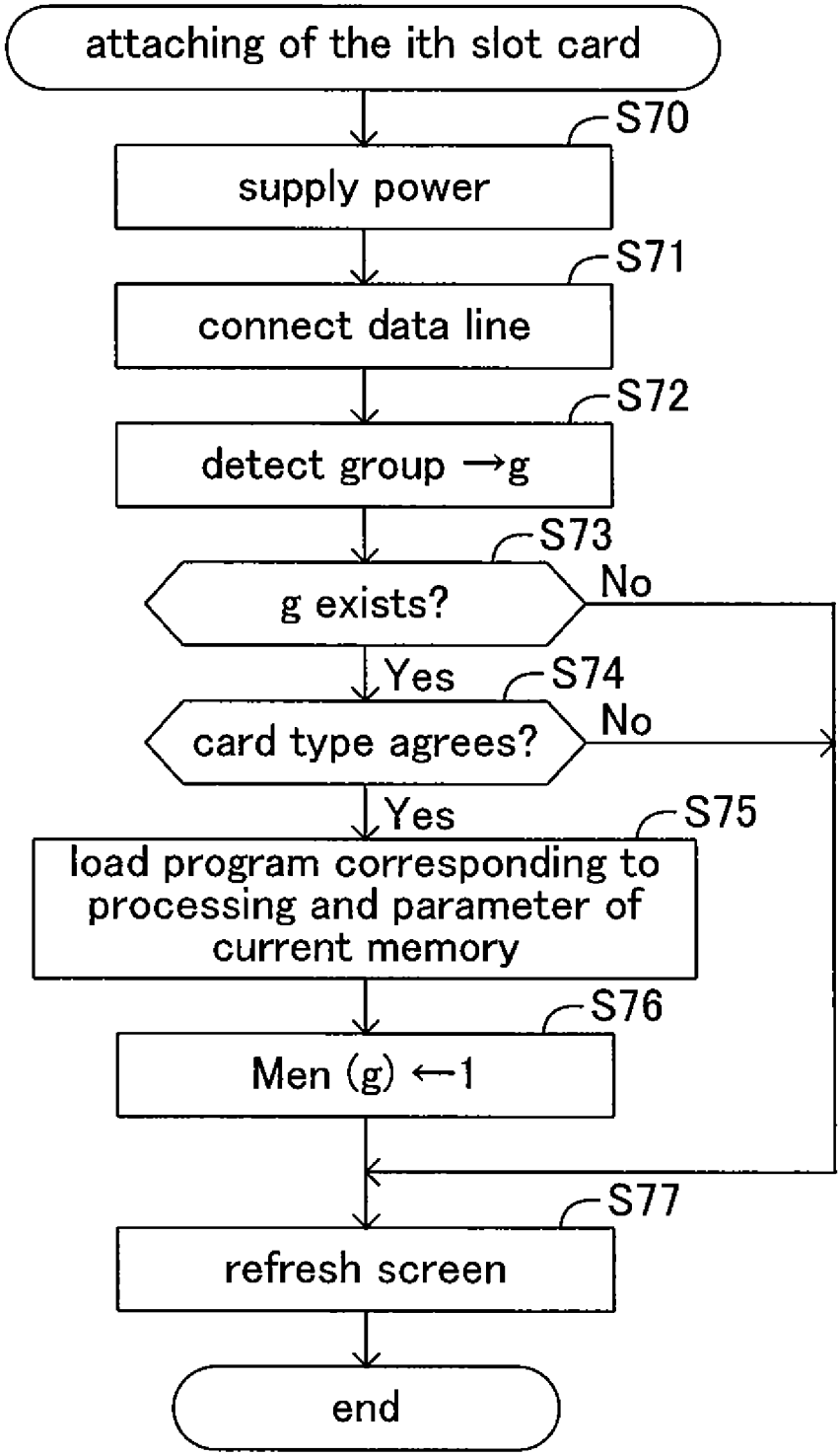
FIG. 14 is a flowchart of a process for attaching the (i)th slot processing card, the process being executed on the audio signal processing apparatus of the embodiment of the present invention.

FIG. 14 shows a flowchart of a process for attaching the (i)th slot processing card, the process being executed when a processing card is attached to the slot of the (i)th node. When a processing card is attached to the slot of the (i)th node, the process for attaching the (i)th slot processing card is started. In step S70, power is supplied from the hot swap circuit 25*c* of the card I/O (i) to the attached card to make the card operative. In step S71, the data signal line is connected through the hot swap circuit 25*c*. In step S72, a process for detecting the group g to which the (i)th node to which the processing card is attached belongs is performed. In the detection process, if it is determined in step S73 that the group g has been detected, the process proceeds to step S74 to determine whether the attached processing card agrees with the card type of the detected group g. If it is determined that the type of the attached processing card agrees with the card type of the group g, the process proceeds to step S75 to load, into the attached processing card, a program corresponding to the type of processing of the nodes of group g and parameters for signal processing stored in the current memory (for cards) provided for the nodes of the group g.

Because the cards have been mounted to the two nodes which configure the group g, the flag Men (g) is reversed to "1" in step S76. Because the group g has become dual-redundancy, the switch screen is refreshed to add the group g to the switch screen shown in FIG. 10 and to refresh the system setting screen to display the card type of the (i) th node in step S77. The process for attaching the (i)th slot processing card is then terminated. If it is determined in step S73 that there is no group to which the attached processing card belongs, or if it is determined in step S74 that the card type of the attached processing card does not agree with the card type of the detected group g, the process proceeds to step S77 to refresh only the system setting screen to display the card type of the (i)th node. The process for attaching the (i)th slot processing card is then terminated.

Figure 15:
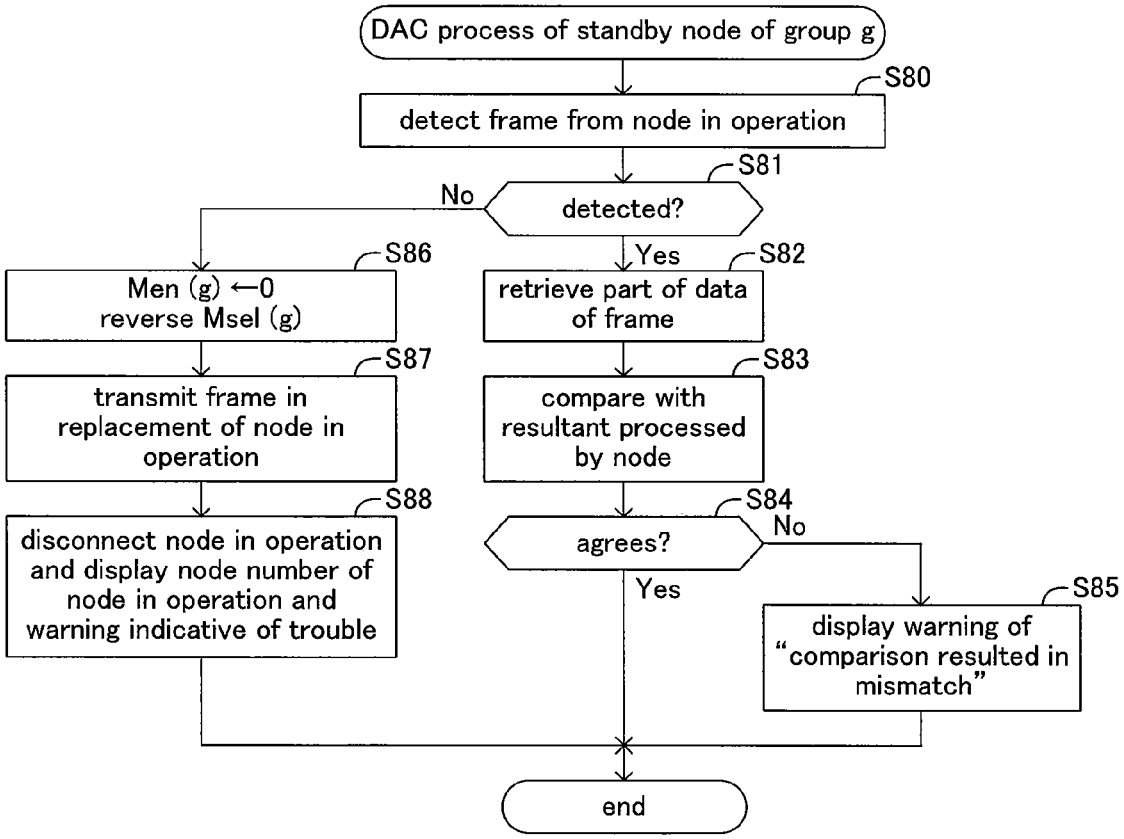
FIG. 15 is a flowchart of a DAC process of standby node of group g, the process being executed on the audio signal processing apparatus of the embodiment of the present invention.

The audio signal processing apparatus 1 of the present invention is designed such that, in the event a failure occurs in the node which is in operation, so that the node in operation is unable to transmit an assigned frame, the nodes of dual-redundancy of operation and standby are allowed to switch the node on standby to the one which is in operation to transmit audio signals through the assigned frame. FIG. 15 shows a flowchart of such a DAC process of standby node of group g. The DAC process of standby node of group g is started at the timing when the node which is on standby transmits a frame. In step S80, a detection process for detecting transmission of a frame from the node which is in operation is carried out. In the detection process, detection of a frame is executed during a certain detection time period. In step S81, it is determined whether or not a frame has been detected in the detection process.

If it is determined that a frame has been detected, the process proceeds to step S82 to retrieve part of data included in the detected frame to compare in step S83 the retrieved data with resultant data processed by the node which is on standby. The process then proceeds to step S84 to determine whether the retrieved data agrees with the resultant data or not. Since the two nodes which are in operation and on standby are designed to execute the same processing, the comparison results in good agreement under normal operating conditions. If it is determined that the comparison results in good agreement, the DAC process of standby node of group g is immediately terminated, for the node which is in operation operates normally. If it is determined in step S84 that the comparison does not result in good agreement, a warning of "comparison resulted in a mismatch" is displayed on the display unit 14, for there is a possibility that there is anything wrong with the node which is in operation. The DAC process of standby node of group g is then terminated. The DAC process of standby node of group g thus allows the user to check the operation of the respective nodes of the group g.

If it is determined in step S81 that any frame has not been detected, the process proceeds to step S86, for it is determined that anything is wrong with the node which is in operation of the group g. In step S86, more specifically, the flag Men (g) is reversed to "0" in order to cancel the enabled state of the group g, while a flag Msel (g) is reversed in order to replace the troublesome node with the node which is on standby to turn the node on standby to the one which is in operation. In step S87, a frame assigned to the group g is transmitted from the node which has been on standby in replacement for the troublesome node. In step S88, the card of the node which has been in operation is disconnected, while the node number of the node which has been in operation and a warning indicative of a trouble are displayed on the display unit 14. The DAC process of standby node of group g is then terminated. The DAC process of standby node of group g thus allows the user to replace the card in which abnormal conditions have occurred.

Figure 16:
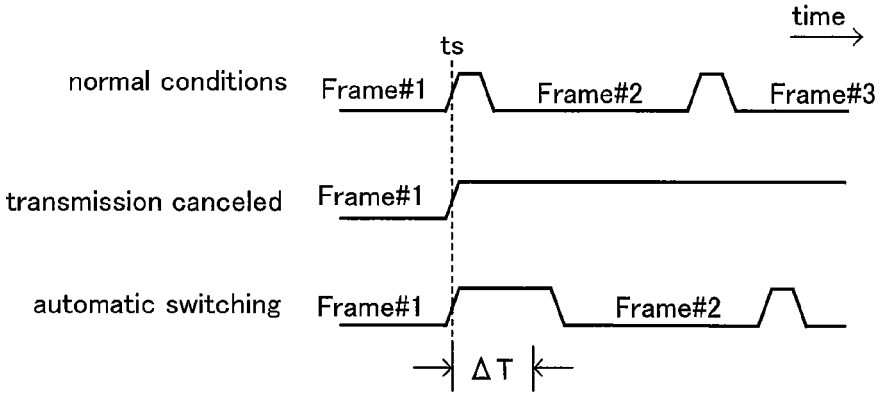
FIG. 16 is a diagram of timing showing a concrete example of a frame detection process executed on the audio signal processing apparatus of the embodiment of the present invention.
Figure 17:
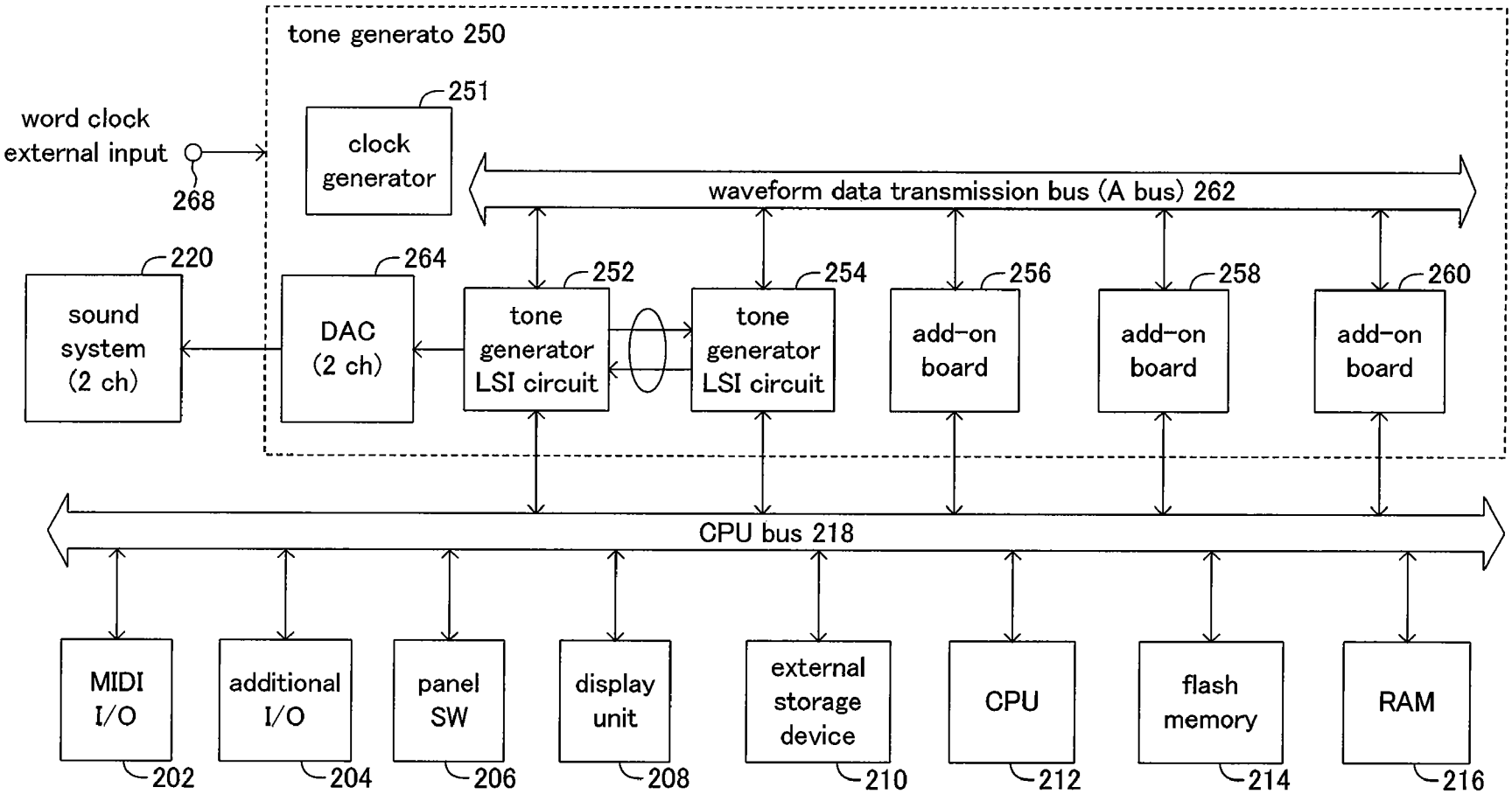
FIG. 17 is a block diagram showing an example configuration of a conventional musical tone synthesizer which transmits and receives audio signals through a bus.

A concrete example of the frame detection process executed in step S80 and step S81 will be described with reference to a diagram of FIG. 16 showing timing of frame signals. FIG. 16 indicates "group 1" to focus on frame #2 which is assigned to "group 1". Under normal conditions, when transmission of frame #1 has been completed, a frame signal of frame #1 is pulled up at time ts. The pulling up of the frame signal of frame #1 is detected by dual-redundant "node 3" and "node 4" of "group 1", so that "node 3" which is in operation pulls down a frame signal of frame #2 in order to transmit frame #2 and then starts transmitting frame #2. When the transmission of frame #2 has been completed, "node 3" pulls up the frame signal of frame #2. The pulling up of the frame signal of frame #2 is detected by "node 5" which is to transmit the subsequent frame #3. "Node 5" then pulls down a frame signal of frame #3 in order to transmit frame #3 and then starts transmitting frame #3.

In a state where something is wrong with "node 3" which serves as an operative node for "group 1", when transmission of frame #1 has been completed, a frame signal of frame #1 is pulled up at time ts, but "node 3" will not pull down a frame signal of frame #2 in order to transmit frame #2 to refrain from transmitting frame #2. Under abnormal conditions, as described above, the transmission of frame #2 is canceled, so that transmission of frame #2 and later frames will not be accomplished. During a detection period ΔT for which an allowance is provided, "node 4" which serves as standby for "group 1" determines whether the frame signal of frame #2 is pulled down. If "node 4" determines that the frame signal of frame #2 is not pulled down, "node 4" which is on standby pulls down the frame signal of frame #2 in order to transmit frame #2 and then starts transmitting frame #2. As a result, transmission of frame #2 is accomplished, resulting in normal transmission of frame #2 and later frames. Audio signals transmitted through frame #2 are those processed by "node 4" in the same manner as those processed by "node 3". Even if any trouble occurs in "node 3", therefore, transmission of audio signals can be accomplished without a break. The detection period ΔT is designed to have a longer period in time than at least margin time between frames.

INDUSTRIAL APPLICABILITY

The above-described audio signal processing apparatus 1 according to the present invention is allowed to have the dual-redundant nodes which are in operation and on standby which are provided with a processing card, respectively. To the two nodes of dual-redundancy of an operative node and a standby, the same input signals and parameters for signal processing are supplied. In a case where a program is to be loaded to the nodes, the same program is loaded into the two nodes to allow the nodes to execute the same signal processing. However, only the node which is in operation is permitted to output signals.

Furthermore, the user is allowed to freely switch the two nodes of dual-redundancy between operative node and standby node. In this case, the switching between the operative node and the standby node is done in the same sampling (DAC) cycle in order to prevent interruptions of transmission of audio signals.

In addition, the cards of the two nodes of dual-redundancy of operative node and standby node can be hot-swapped. More specifically, by instructing to detach the processing card which the user desires to detach, the user is allowed to detach the processing card from the slot. In this case, if the processing card serves as the processing card of the node which is in operation, the process executed when the user instructs to detach the processing card causes automatic switching between the nodes which are in operation and on standby.

If anything is wrong with the dual-redundant node which is in operation, the standby node is allowed to transmit processed audio signals of a frame to the A bus 26 without a break in audio signals.

The number of the nodes provided for the audio signal processing apparatus 1 is 8. However, the number of the nodes may be 16 or 24. The number of channels through which the A bus 26 is allowed to transmit signals is 512 or less. However, the number of channels may be 1024 or 2048.

What is claimed is:

1. An audio signal processing apparatus for processing digital audio signals at each sampling cycle, the audio signal processing apparatus comprising:

an audio bus on which a plurality of frames, each containing audio signals, are transferred in turn at each sampling cycle; and a plurality of nodes each of which outputs one frame assigned to the node to the audio bus at each sampling cycle, wherein the plurality of nodes include a node in operation and a node on standby for redundancy; and wherein the node in operation and the node on standby are controlled to capture the same audio signals in the same frame on the audio bus at each sampling cycle and supplied with the same control signals for controlling the operations of the nodes, such that both the node in operation and the node on standby execute the same signal processing on the input same audio signals in accordance with the supplied same control signals, respectively;

both the node in operation and the node on standby are set to output the same frame to the audio bus, but only the node in operation is permitted to output the frame in which the processed audio signals are contained, and the node on standby is prohibited from outputting the frame to the audio bus; and in response to a switch instruction, the node in operation stops outputting the frame to the audio bus and turns to be on standby in a sampling cycle, and the node on standby starts to output the frame to the audio bus and turns to be in operation in the same sampling cycle.

2. An audio signal processing apparatus according to claim 1, wherein at least one of the plurality of nodes comprises an interface to the audio bus and a processing card, detachably connected to the interface, having a function of processing the input audio signals in accordance with the control signals;

data transfer between the processing card and the interface is slower than the frame transfer on the audio bus; and the processing card of a node on standby can be detached from the interface of the node or attached to the interface without affecting the frame transfer on the audio bus.

3. An audio signal processing apparatus according to claim 2, wherein the processing card in the node has a clock generator for generating operational clock used for signal processing; and the interface in the node in operation outputs the frame containing audio signals processed in the processing card to the audio bus in synchronization with the operational clock and transfers the audio signals, captured from the frame on the audio bus, to the processing card in synchronization with the operational clock.

4. An audio signal processing apparatus according to claim 1, wherein when an abnormality is detected in the node in operation, the node on standby automatically starts to transmit the frame to the audio bus in replacement for the abnormal node and turns to be in operation.

5. An audio signal processing apparatus for processing digital audio signals at each sampling cycle, the audio signal processing apparatus comprising:

an audio bus on which a plurality of frames, each containing audio signals, are transferred in turn at each sampling cycle; and a plurality of nodes each of which outputs one frame assigned to the node to the audio bus at each sampling cycle, wherein the plurality of nodes include a node in operation and a node on standby for redundancy; and wherein the node in operation and the node on standby are controlled to capture the same audio signals in the same frame on the audio bus at each sampling cycle and supplied with the same control signals for controlling the operations of the nodes, such that both the node in operation and the node on standby execute the same signal processing on the input same audio signals in accordance with the supplied same control signals, respectively;

both the node in operation and the node on standby are set to output the same frame to the audio bus, but only the node in operation is permitted to output the frame in which the processed audio signals are contained, and the node on standby is prohibited from outputting the frame to the audio bus;

each of the plurality of nodes comprises an interface to the audio bus and a processing card, detachably connected to the interface, having a function of processing the input audio signals in accordance with the control signals; and in response to an instruction to detach the processing card in the node in operation, the node in operation stops outputting the frame to the audio bus and turns to be on standby in a sampling cycle, and the node on standby starts to output the frame to the audio bus and turns to be in operation in the same sampling cycle and the processing card is disconnected electrically from the interface and allowed to be detached from the interface.

6. An audio signal processing apparatus according to claim 5, wherein in response to an instruction to detach the processing card in the node on standby, the processing card of the node is disconnected electrically from the interface and allowed to be detached from the interface.

7. An audio signal processing apparatus according to claim 5, wherein when the processing card is allowed to be detached, power supply from the interface to the processing card is stopped.

8. An audio signal processing apparatus according to claim 6, wherein when the processing card is allowed to be detached, power supply from the interface to the processing card is stopped.

* * * * *